US008387686B2

(12) United States Patent
Smith et al.

(10) Patent No.: US 8,387,686 B2
(45) Date of Patent: Mar. 5, 2013

(54) AUTOMOTIVE HEAT EXCHANGER ASSEMBLIES HAVING INTERNAL FINS AND METHODS OF MAKING THE SAME

(76) Inventors: Paul R. Smith, Sinclairville, NY (US); Kellie M. Irish, Stockton, NY (US); Sam J. Lamancuso, Jamestown, NY (US); Kevin L. Freestone, Warren, PA (US); David S. Johnson, Kennedy, NY (US); Terrence P. Lynch, Frewsburg, NY (US)

( * ) Notice: Subject to any disclaimer, the term of this patent is extended or adjusted under 35 U.S.C. 154(b) by 217 days.

(21) Appl. No.: 12/347,436

(22) Filed: Dec. 31, 2008

(65) Prior Publication Data

US 2009/0166020 A1 Jul. 2, 2009

Related U.S. Application Data

(62) Division of application No. 11/190,484, filed on Jul. 27, 2005, now Pat. No. 7,487,589.

(60) Provisional application No. 60/591,680, filed on Jul. 28, 2004.

(51) Int. Cl.
*F28F 9/013* (2006.01)

(52) U.S. Cl. ..... 165/173; 165/183; 165/906

(58) Field of Classification Search ..... None
See application file for complete search history.

(56) References Cited

U.S. PATENT DOCUMENTS

| | | | | |
|---|---|---|---|---|
| 2,488,615 | A | | 11/1949 | Arnold |
| 2,757,628 | A | | 8/1956 | Johnston |
| 2,899,177 | A | | 8/1959 | Harris et al. |
| 4,501,321 | A | | 2/1985 | Real et al. |
| 4,805,693 | A | * | 2/1989 | Flessate ..... 165/153 |
| 4,813,112 | A | | 3/1989 | Pilliez |
| 5,105,540 | A | | 4/1992 | Rhodes |
| 5,185,925 | A | * | 2/1993 | Ryan et al. ..... 29/890.049 |
| 5,372,188 | A | | 12/1994 | Dudley et al. |
| 5,511,613 | A | | 4/1996 | Mohn et al. |
| 5,555,729 | A | | 9/1996 | Momose et al. |
| 5,560,424 | A | | 10/1996 | Ogawa |
| 6,032,728 | A | * | 3/2000 | Ross et al. ..... 165/153 |
| 6,192,977 | B1 | | 2/2001 | Dey et al. |
| 6,213,158 | B1 | | 4/2001 | Rhodes et al. |
| 6,571,473 | B1 | | 6/2003 | Nozaki et al. |
| 6,640,886 | B2 | * | 11/2003 | Lamich ..... 165/174 |
| 2005/0161194 | A1 | * | 7/2005 | Emrich et al. ..... 165/76 |
| 2005/0247444 | A1 | | 11/2005 | Ohata et al. |

FOREIGN PATENT DOCUMENTS

| | | |
|---|---|---|
| EP | 1243884 | 9/2002 |
| FR | 2777645 | 10/1999 |
| GB | 1533466 | 11/1978 |
| GB | 2394037 | 4/2004 |
| JP | 61110892 | 5/1986 |
| WO | WO 03/093751 | 11/2003 |
| WO | WO 2004/005831 | 1/2004 |

* cited by examiner

*Primary Examiner* — Allen Flanigan

(74) *Attorney, Agent, or Firm* — Dierker & Associates, P.C.

(57) ABSTRACT

The present disclosure relates to automotive heat exchanger assemblies that may withstand high environmental temperature and pressures conditions. By providing a tube strengthener into the tubes at the areas of highest stress, the heat exchanger assembly may be strengthened so that it is substantially more efficient under typical operating conditions.

24 Claims, 8 Drawing Sheets

AUTOMOTIVE HEAT EXCHANGER ASSEMBLIES HAVING INTERNAL FINS AND METHODS OF MAKING THE SAME

CROSS-REFERENCE TO RELATED APPLICATIONS

This application is a divisional application of U.S. application Ser. No. 11/190,484 filed Jul. 27, 2005 now U.S. Pat. No. 7,487,589, which itself claims the benefit of U.S. Provisional Application Ser. No. 60/591,680, filed Jul. 28, 2004. These applications are herein incorporated by reference in their entirety.

BACKGROUND

The present disclosure relates generally to automotive heat exchangers and, more particularly, to brazed heat exchangers.

Various types of heat exchangers are used in automotive applications. For example, WO 03093751, published on Nov. 13, 2003, assigned to Behr, relates to a radiator with an internal fin section, and a short section of tube inside a primary tube. In various evaporator applications, such as, for example, in WO 2004/005831, evaporators are provided with a fin that fits against the tube radius for the full length of the tube. U.S. Pat. No. 5,105,540 issued on Apr. 21, 1992 to Ford Motor Company shows a tube with an internal liner stock for increasing interior fluid turbulation. U.S. Pat. No. 4,501,321 issued on Feb. 26, 1985 to Blackstone Corporation shows a two piece tube with an overlap occurring at the minor dimension. U.S. Pat. No. 4,813,112, issued on Mar. 21, 1989 to Societe Anonyme des Usines Chausson shows a reinforcement plate on an ambient side of a header to locally reinforce a tube-to-header joint. U.S. Pat. No. 4,805,693 issued on Feb. 21, 1989 to Modine Manufacturing shows a two-piece tube with an overlap occurring at the diameter of the tube. The above references are herein incorporated by reference.

In recent years, the temperatures and pressures of so-called 'turbo-charged' air has significantly increased resulting in failure of heat exchangers, such as those of prior art charge air coolers (CACs), and after coolers due to thermal stresses. In such temperature/pressure conditions, a major disadvantage of prior art designs includes common failures, such as fatigue fracture, of both the tube and the internal fin.

In prior art designs, specific fractures, such as transverse fractures, may occur, for example, at tube locations, and, in particular, at the inlet header of the heat exchanger. Also, internal fin fracture may occur and lead to contamination in heat exchangers such as the charge air in coolers.

Higher temperatures and pressures for CACs are being specified by customers. Even with material changes, increased thickness of materials will be needed to meet these new requirements. Increasing material thickness further drives up costs. One solution is to increase the robustness of the tube by increasing the thickness of the tube and the internal fin. Another solution is to use high strength alloys. Although effective in improving durability, these changes require significant tooling, process change(s), material cost(s), and overall cost(s) to produce a durable charge air cooler.

There exists a need for a heat exchanger assembly with localized strength which is cost effective and improves durability with increasing pressure/temperature applications.

SUMMARY

The present disclosure provides a heat exchanger assembly especially comprising a heat exchanger such as an after cooler or charge air cooler for automotive applications. A tube strengthener is provided to allow for a more thermally resistant or 'robust' after cooler or charged air cooler. Specifically, aspects of the present disclosure provide for an increase in resistance to thermal and pressure stresses in the heat exchanger or the heat exchanger assembly and, especially, in and near specific areas in which thermal fatigue failures may occur (e.g., an area of a tube and an internal fin at or next to a header in the heat exchanger assembly). The tube strengthener can be used at any location in the heat exchanger or heat exchanger assembly that needs additional strength.

The present disclosure in various embodiments provides an improved thermal/pressure resistant heat exchanger for a heat exchanger assembly (e.g., the heat exchanger having an increased thermal durability yielding an increased functional life of the heat exchanger assembly) in high pressure and/or high temperature environments found in after coolers and, especially, in charge air coolers.

DETAILED DESCRIPTION

Figure 1:
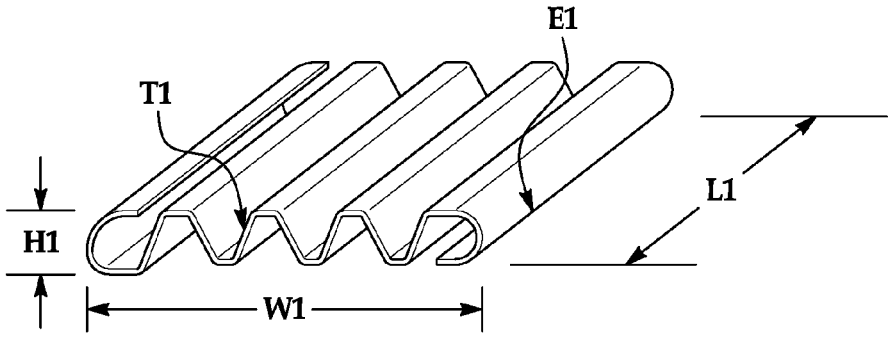
FIG. 1 is an elevational schematic view of a tube strengthener-end contact, in accordance with an aspect of the present disclosure.

A strengthened tube wall as in embodiments of the present disclosure for after cooler and CAC heat exchanger assemblies has greatly reduced or even insignificant and/or largely inconsequential effects on heat transfer and internal restriction, as opposed to prior art CAC heat exchanger assemblies without such tube strengtheners.

Preferred aspects of the present disclosure provide improved thermal durability without a major design change from presently used heat exchanger designs that affect the complete heat exchanger. These aspects affect a localized portion of the heat exchanger and may be applied to current designs using minor modifications to current manufacturing processes. Cost reduction opportunities exist by allowing for use of thinner and less expensive alloys on both the tubes and the internal fins, as well as providing for a more competitive method of achieving increasing design requirements with current technologies. In particular, the use of the tube strengthener allows design elements at a specific location or locations in the cross section of a tube with one variation providing differing thickness(es) in one or more of the structural elements.

As referred to herein, a "tube strengthener" is a complete modified inner or internal fin or a piece, part, or section of a modified inner or internal fin, that may be used to provide strength to an area of stress or stress in the tube, while retaining some heat transfer properties. The inner or internal fin is typically placed inside the heat exchanger tube prior to brazing the heat exchanger assembly. The inner or internal fin (hereafter "internal fin") when brazed to an interior wall of the heat exchanger tube forms a structure resistant to the required operating temperatures/pressures of the heat exchanger, as well as additional heat transfer surfaces. The tube strengthener is designed to be applied to localized areas in the heat exchanger where temperature/pressure stress resistance is greater than that provided by the internal fin in order to meet durability requirements while retaining some heat transfer properties.

As shown in FIG. 2, a complete fin may be comprised of pieces, parts, or sections, particularly end sections, where the sections are the outermost or the first and/or final internal fin(s). In embodiments of the present disclosure, the tube strengthener and, in certain circumstances, the tube strengthener replacing the end internal fin and, more particularly, the outermost or the first and/or final internal fin(s) are provided. Prior art tubes and inner fins are typically thickened or employ high strength alloys to resist increasing temperature and pressure stresses. The aspects of the present disclosure, by applying the tube strengthener at selected locations of the final heat exchanger assembly, not only maintains but substantially increases the functional life span of the heat exchanger assembly, particularly in an after cooler and, more particularly, in charge air cooler applications. In some embodiments of the present disclosure, the tube strengthener may be brazed to the inner tube wall contacting it. In even more preferred embodiments, the tube strengthener increases the overall tube wall thickness or width at the area of contact, more preferably, the thickness of the strengthener plus the tube wall thickness is equal to or greater than the normal tube wall thickness. In most preferred embodiments, the tube strengthener is positioned at the area of high and, in particular, the highest thermal stress in the heat exchanger assembly, for example, between the tube and the header, or in other appropriate locations.

The present disclosure, in its various aspects, is likely to reduce the likelihood of internal fin fracture during heat exchanger operation(s), and is likely to decrease the overall rate of potential fracture and propagation of such fractures through heat exchanger assemblies tubes and, particularly, after cooler and CAC heat exchanger assembly tube walls.

In one aspect of the present disclosure, at least one tube strengthener, which hereafter is known as the tube strengthener-end contact, is provided. As referred to herein, the "tube strengthener-end contact" is a modified or formed fin with a thickness equal to or greater than the internal fin which it substitutes, which preferably replaces or is located in the area where normally is located an outermost internal fin in the tube of the heat exchanger, which fin or part of fin is especially formed to contact the internal surface of the minor tube dimension being brazed to the minor tube dimension and retaining some heat transfer properties while improving temperature/pressure durability at a specific location in the heat exchanger. By design, the features of the tube strengthener-end contact allow for contact with an inner surface or surfaces of the heat exchanger tube at an identified or determined location or locations of highest stress, normally the minor dimension, the stress areas affected by providing additional thickness of material directly at and adjacent to the location of greatest stress.

In aspects of the present disclosure, by using the tube strengthener-end contact comprising a modified formed internal fin, durability of the heat exchanger is increased by brazing the tube strengthener-end contact to the interior surface of a tube, especially in place of an existing internal fin and on an inside surface of the tube minor dimension, which is typically the location of highest stress in the tube. These aspects of the present disclosure allow a resistance to thermal fatigue in high stress areas. By providing for a structure and, in particular, an increase in the tube wall thickness on the minor dimension existing material, thicknesses and alloys may be used in all but the highest stress area of a CAC. Reduced material gages are possible in such heat exchangers, while having an improvement in cost of the heat exchanger assembly. By determining the area of need for strength in the tube of the heat exchanger, different tube strengthener-end contact thicknesses and fin pitches may be specified. In embodiments of the present disclosure, use of a tube strengthener-end contact increases wall thickness in the tube's end radius where fractures often occur. In accordance with these aspects, the highest thermal/pressure stress concentration problems are typically at the radius of the tube adjacent to the tube-to-header braze joint, which are solved by using the tube strengthener.

As described hereinabove, various aspects of the present disclosure add strength to heat exchangers, such as CACs, at specific locations of highest stress, normally within the first sections of tube past an end of an inlet tube. In some of the preferred aspects, the strength is added by inserting a short section of the tube strengthener-end contact, such as the internal fin or fin section of greater than 25% of the thickness of the tube wall, and brazing a portion of the thickened internal fin across the location of highest stress to create a thickened tube strengthening structure that resists thermal fatigue in the high stress area, which typically is the minor dimension of the tube. These aspects or embodiments enable the formation of the heat exchanger requiring no more than the standard or existing material thicknesses and use of traditionally used alloys in all but the highest stress area of the heat exchanger, such as a CAC. Reduced material gages are possible in such heat exchangers, while having an improvement in cost characteristics of the heat exchanger assembly for lower temperature/pressure applications.

In one aspect of the present disclosure, at least one tube strengthener, which hereafter is known as the tube strengthener-structural, is provided. As referred to herein, the "tube strengthener-structural" is a modified or formed fin or fin section with a thickness equal to or greater than the internal fin which it substitutes, which preferably replaces or is located in the area where normally is located an outermost internal fin in the tubes of the heat exchanger, which fin is especially formed to contact the locations of highest stress in the tube and also having a structure formed into the tube strengthener-structural adjacent to the location of highest stress, being brazed to the minor tube dimension and retaining some heat transfer properties while improving temperature/pressure durability at a specific location in the heat exchanger. By design, the features of the tube strengthener-structural allow for contact with the inner surface or surfaces of the heat exchanger tube at an identified or determined location or locations of highest stress, normally at a portion of minor dimension. The stress areas are affected by providing additional thickness of material directly at the location of greatest stress with additional strengthening by having a structure adjacent to the location of highest stress to further resist thermal/pressure stresses.

In aspects of the present disclosure using the tube strengthener-structural comprising a modified formed internal fin, durability of the heat exchanger is increased by brazing the tube strengthener-structural to the interior surface of a tube, especially in place of an existing internal fin and at the location of highest stress which is normally on the inside surface of the tube minor dimension with a structural feature formed into the tube strengthener-structural adjacent to the location of highest stress in the tube. These aspects of the present disclosure allow a resistance to thermal fatigue in high stress areas. By providing for an adjacent structure and, in particular, an increase in the tube wall thickness at the location of highest stress, existing material thicknesses and alloys may be used in all but the highest stress area of a CAC. Reduced material gages are possible in such heat exchangers, while having an improvement in cost of the heat exchanger assembly. By determining the area of need for strength in a tube of the heat exchanger, different tube strengthener-structural thicknesses, formed structures, and fin pitches may be specified. In embodiments of the present disclosure, use of the tube strengthener-structural increases the wall thickness at the location of highest stress where fractures often occur and additionally forms a stiffening structure into the tube strengthener-structural adjacent to the location of highest stress for further resistance to thermal fatigue. In accordance with these aspects, the highest thermal/pressure stress concentration problems are typically at a radius of the tube adjacent to the tube-to-header braze joint, which are solved by use of the tube strengthener-structural.

As described hereinabove, various aspects of the tube strengthener-structural add strength to the heat exchangers, such as CACs, at specific locations of highest stress normally within the first sections of a tube past the end of the inlet tube. In some of the preferred aspects, the strength is added by inserting a short section of the tube strengthener-structural, such as an internal fin section of greater than 25% the thickness of the tube wall, brazing a portion of the thickened internal fin across the location of highest stress to create a thickened tube strengthening structure with an additional formed structure that resists the thermal fatigue in the high stress area, which typically will be at the minor dimension of a tube. These aspects or embodiments enable heat exchanger formation requiring no more than standard or existing material thicknesses and use of traditionally-used alloys in all but the highest stress area of the heat exchanger, such as a CAC. Reduced material gages are possible in such heat exchangers, while having an improvement in cost characteristics of the heat exchanger assembly for lower temperature/pressure applications.

In one aspect of the present invention, at least one tube strengthener, which hereafter is known as a tube strengthener-extruded, is provided. As referred to herein, the "tube strengthener-extruded" is an extruded internal fin, the tube strengthener having a central web or multi-structural support feature or element, which substitutes, replaces, or is located in an area where, in preferred embodiments, normally is located an outermost internal fin in the tubes of the heat exchanger and, in specific embodiments, of a CAC while retaining some heat transfer properties. The central web is designed to have projections in it at specific or selected locations. The preferred embodiments of the present invention have at least one, preferably, a plurality of extruded projections with a multi-structural support feature or element (central web) designed to fit into a tube of the heat exchanger in place of, in substitution of, or placed where would normally be located a traditional internal fin or section. By design, the features attached to the central web allow for contact with the inner surface or surfaces of a heat exchanger tube at an identified or determined location or locations of highest stress. The stress areas are affected in at least two different ways: by providing a direct structure to resist the thermal forces, and to provide additional thickness of material directly at and only at the location of greatest stress.

In aspects of the present disclosure, using the tube strengthener-extruded comprising extruded internal fin (extruded tube strengthener) durability is increased by inserting a structure (for example, a section or sections of extruded internal fin), typically a structure or structures which are projections, extensions, branches, or arms off a central web. In aspects of the present disclosure where heat exchangers are brazed, the structures are brazed to the inside of a tube at the locations of highest stress. These aspects allow a resistance to thermal fatigue in high stress areas. By providing for a structure and, in particular, a structure coming off of a central web arrangement, existing material thicknesses and alloys may be used in all but the highest stress area of the CAC. Use of such a structure and, in particular, a structure coming off of a central web in embodiments of the present disclosure are also used to reduce material gages in CACs with a corresponding improvement in cost control and performance enhancement. The section thickness of, for example, the projections can vary to add material into areas of highest stress and minimize material in lower stress areas. The use of varying material thickness in the embodiments of the present disclosure utilizing the tube strengthener-extruded also assists in minimizing a potential pressure drop affect due to tube blockage at its opening or other such blockage(s). Also in embodiments of the present disclosure, the structural projection, extension, branches, arms, or the like may be of various thicknesses. By determining the area of need for strength in the tube of the heat exchanger, different structural projections, extensions, branches, arms, or the like may be of different thicknesses at different locations off the central web. The use of the extruded tube strengthener, in embodiments of the present disclosure, with a central web adds strength to a specific location or locations of highest thermal/pressure stress in the CAC. Also, the amount of material used to provide the maximum strength is provided by providing increased thickness and structure, as needed, in the location or locations of highest thermal/pressure stress. These aspects or embodiments enable heat exchanger manufacture (formation) requiring no more than the standard or existing material thicknesses and use of traditionally-used alloys in all but the highest stress area of the heat exchanger, such as the CAC. Reduced material gages are possible in such heat exchangers, while having an improvement in cost characteristics of the heat exchanger assembly for lower temperature/pressure applications.

Aspects of the present disclosure solve various problems including the strength problem by adding strength, for example, to the CAC at a specific location or locations of highest stress, normally within the first 25 mm past the end of the inlet tube.

One aspect of the tube strengthener significantly reduces the potential of failures and, particularly, thermal/pressure fatigue failures. In preferred embodiments of the present disclosure, it has been found that thermal stress resistance upward of 200 percent to about 400 percent or more may result using some embodiments of the present disclosure with the tube strengthener leading to significant durability of both the tube and the heat exchanger assembly.

Alternative or preferred embodiments of the present disclosure provide a cost effective method for increasing the thermal/pressure resistance or thermal durability of CAC designs in high temperature applications (>220 C). Additional potential of reducing material costs in high temperature applications (>220 C) also exists.

Additional embodiments provide a concurrent reduction in tube thickness and, particularly, internal fin thickness without deleteriously affecting the thermal/pressure durability of the heat exchanger assembly, particularly in after cooler or CAC applications, in lower temperature environments (<220 C).

The embodiments of the present disclosure further preferably provide for greatly improved thermal/pressure durability without the cost associated with design, tooling, or major process changes seen in the prior art.

By distributing stress (reducing fatigue) associated with the bending moment, particularly amongst internal components of the CAC (e.g. the tube and the core versus the header and the tank) stress is taken away or substantially reduced in the high stress area or the area of stress concentration such as that found at the braze joint with the header.

In embodiments of the present disclosure, the tube strengthener is positioned at high stress areas or areas of stress concentration to eliminate the potential of outer internal fin fracture near or at the inlet header and subsequent or associated propagation of fracture through the tube wall.

In preferred methods of the present disclosure, minor modification(s) of manufacturing operation(s) with no additional labor or other significant modifications provides for the heat exchanger with the tube strengthener with the qualities of increased lifetime for the heat exchanger assemblies, particularly in CAC applications.

In preferred methods of the present disclosure, manual or automated means may be used for tube stuffing (i.e. insertion of the internal fin into the tube).

In a particularly preferred method of the present disclosure, an automated tube stuffer is provided to insert the internal fin into the tube, wherein the tube location within the core and within the tube strengthener replaces the first and/or final internal fin or fin portions inserted into the tube. Also in preferred embodiments of the present disclosure, the tube strengthener may be applied to ameliorate stresses in CAC designs. The internal fin is replaced by the tube strengthener at the areas of highest stresses.

The present disclosure also provides, in one aspect, a method for reducing contamination of charged air by, for example, internal fins which typically cleave chips on the inlet side of the CAC due to the high stresses at the inlet tube-to-header joint. By positioning the tube strengthener in an area of stress in the tube wall, brazing the tube strengthener as part of the heat exchanger brazing process subsequently reduces contamination from the internal fin in charge air coolers. In aspects of the present disclosure, there is a heat exchanger assembly comprising a first end tank, a second end tank opposite the first end tank, at least one tube in fluid communication with the first and second end tanks, the at one least tube adapted to have a fluid flow therethrough, at least one tube strengthener, and at least one internal fin, wherein the at least one tube strengthener and the at least one internal fin is positioned inside the at least one tube. In particular embodiments of the present disclosure, the heat exchanger assembly is brazed. In particular embodiments of the present disclosure, the at least one tube and at least one of the first end tank or the second end tank contact each other to form a header joint. Embodiments of the present disclosure have a tube strengthener that is a tube strengthener-end contact or tube strengthener-structural, or the tube strengthener is a tube strengthener-extruded.

In some preferred embodiments of the present disclosure, a modified fin is positioned inside the tube such that the modified fin is an outermost modified fin that contacts and follows the contour of an inside wall of the tube on either the radius or minor dimension of the tube.

The modified fin and tube in embodiments of the present disclosure have an overall thickness at the point of contact, which is approximately equal to or greater than to the thickness of the tube at areas outside of the area of contact between the fin and the tube. In embodiments of the present disclosure, the overall thickness at the point of the header joint is greater than or equal to the thickness of the tube at areas outside of the area of contact between the fin and the tube. Another aspect of the present disclosure comprises a heat exchanger assembly comprising a first end tank, a second end tank opposite the first end tank, at least one tube between the first and second end tanks, and at least one tube strengthener. wherein the at least one tube strengthener is positioned inside the at least one tube. In particular embodiments, the at least one tube is in fluid communication with the first or second end tank. In particular, the at least one tube is adapted to have a fluid flow therethrough. The heat exchanger assembly, in aspects of the present disclosure, for example, may comprise a heat exchanger that is a turbo charger after cooler, charge air cooler, or EGR.

In embodiments of the present disclosure, the tube strengthener abuts the tube at a localized contact area, and the tube strengthener plus the tube at the localized contact area form a strengthened joint comprising the tube, the tube strengthener, and the header where the tube touches or abuts the header (header joint). The header joint may be brazed to form a brazed header joint.

Fluid, in connection with various aspects of the present disclosure, can be, for example, gasses such as air or other gasses, liquids such as cooling automotive fluids, or other fluids, or mixtures of the above.

Referring to FIG. 1, a tube strengthener-end contact having an internal dimension and a length (L1) greater than 5 mm and less than ½ length of the tube that can be placed in an oval, oblong, rectangular, or dome shaped tube, in accordance with an aspect of the present disclosure. The number of fins is dependent on the width (W1) of the tube strengthener. The tube strengthener-end contact is of the width (W1) and height (H1) to match the inner dimension of the tube. Material thickness (T1) is greater than of the design internal fin or greater than 25% of the tube wall thickness. The shape and coverage of the end contact (E1) is dependent on the style of tube chosen and the stresses within the heat exchanger.

Figure 2A:
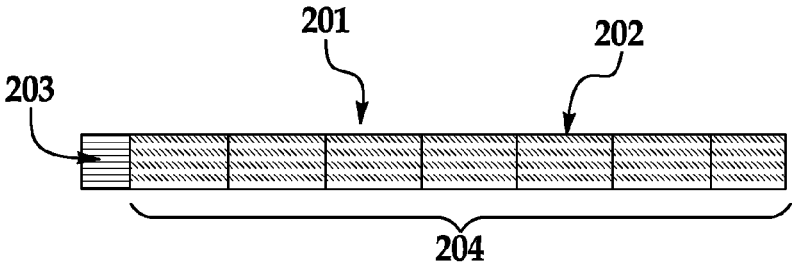
FIG. 2*a* is a schematic top view of internal fin with a tube strengthener in one end of a tube, in accordance with an aspect of the present disclosure.

Referring to FIG. 2*a*, a side view of a tube assembly (201) showing a tube (202) containing a tube strengthener (203) at one end (outermost or final internal fin) with a series of standard internal fin sections (204) is shown. The tube strengthener (203) replaces an outermost internal fin.

Figure 2B:
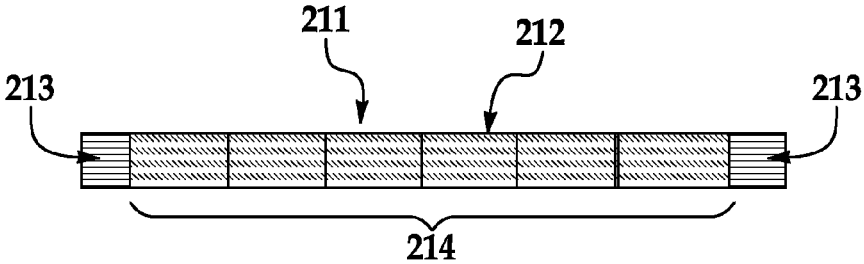
FIG. 2*b* is a cross sectional schematic side view of a tube strengthener in both ends of a tube, in accordance with an aspect of the present disclosure.

Referring to FIG. 2*b*, a side view of a tube assembly (211) showing a tube (212) containing two tube strengtheners (213) at the outer ends with a series of standard internal fin sections (214) in the center. The tube strengtheners (213) replace the outermost or final internal fins.

Figure 3:
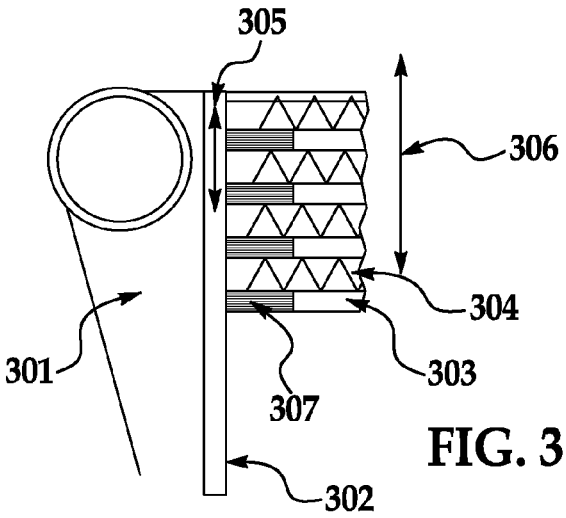
FIG. 3 is a representation of the distribution of stresses from expansion between a header and tubes of heat exchanger assemblies showing a potential placement of a tube strengthener.

FIG. 3 is a representation of the header area of a heat exchanger showing the direction of normal operating stress on a typical charge air cooler and indicating the relative difference in thermal movement between the header thermal stress (305) and the heat exchange portion thermal stress (306). The typical heat exchanger consists of a tank (301), a header (302), an air fin (304), a tube assembly (303), and a tube strengthener (307).

Figure 4A:
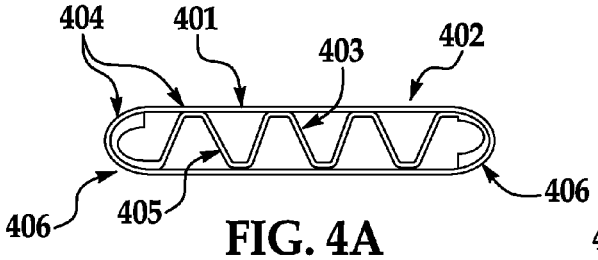
FIG. 4*a-c* is a cross sectional schematic end view of a tube strengthener-end contact in an oval shaped tube, in accordance with an aspect of the present disclosure.
Figure 4B:
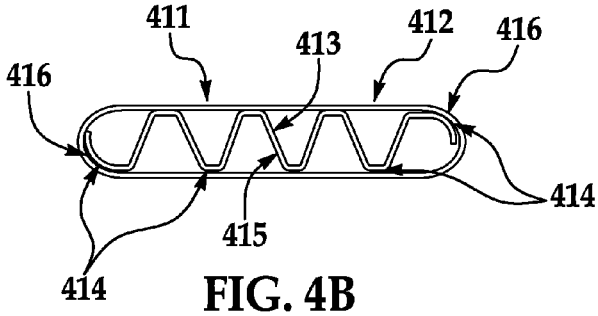
Figure 4C:
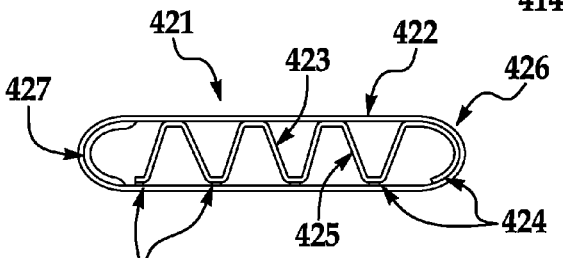

Referring to FIG. 4*a-c*, an oval tube assembly (401, 411, 421) is shown with a tube (402, 412, 422) and a tube strengthener-end contact (403, 413, 423). The tube strengthener-end contact consists of a fin (405, 415, 425) for strength and heat transfer, a localized contact surface (404, 414, 424), and an end contact (406, 416, 426). As shown in FIG. 4*a* (and in other embodiments illustrated in various FIGS.), the tube strengthener 403 is joined to the tube at localized, spaced apart joints 404 that alternate with portions of an inner surface tube 402 that is not in contact with or joined to the tube strengthener. Preferably, the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and the tube strengthener-end contact plus the tube at the localized contact area form a strengthened joint comprising the tube, the tube strengthener, and the header, where the tube touches or abuts the header (header joint). The header joint is brazed to form a brazed header joint.

Referring to FIG. 4*a*, the contour of the tube strengthener-end contact is formed such that the end radius (406) contacts the inner wall of the tube, and preferably, contacts the inner wall of the tube at the localized contact surface (404). The contour of the tube strengthener-end contact completely covers the inside tube minor dimension radius, thereby forming a strengthened joint when the heat exchanger is brazed.

Referring to FIG. 4*b*, the contour of the tube strengthener-end contact is formed such that the end radius (416) contacts the inner wall of the tube, and preferably, contacts the inner wall of the tube at the localized contact surface (414). The localized contact area abuts part of one outer upper end radius on one side of the tube and part of one outer bottom end radius of the respective tube strengthener-end contact on the opposite inside of the tube, the tube strengthener-end contact contacting or abutting only a portion of the inner tube in the area between the inner upper end radius to the bottom end radius of the tube on either end. The contour of the tube strengthener-end contact partially covers the inside tube minor diameter radius, thereby forming a strengthened joint when the heat exchanger is brazed but according to the durability requirements of the heat exchanger.

Referring to FIG. 4*c*, the contour of the tube strengthener-end contact is formed such that the end radius (426) contacts the inner wall of the tube, and preferably, contacts the inner wall of the tube at the localized contact surface (424). The contour of the tube strengthener-end contact covers all or a portion of one inside tube minor dimension radius, thereby forming a strengthened joint when the heat exchanger is brazed. The second inside tube minor diameter radius being a folded tube end (427) and provides a strengthened joint that is supported by the tube strengthener-end contact.

Figure 5A:
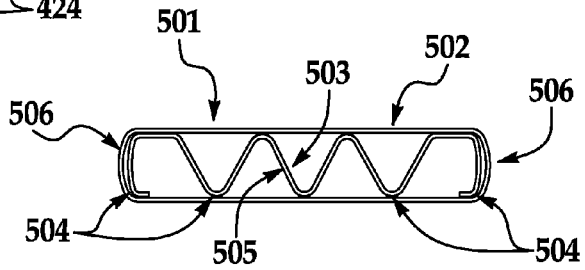
FIG. 5*a-c* is a cross sectional schematic end view of a tube strengthener-end contact in a domed end shaped tube, in accordance with an aspect of the present disclosure.
Figure 5B:
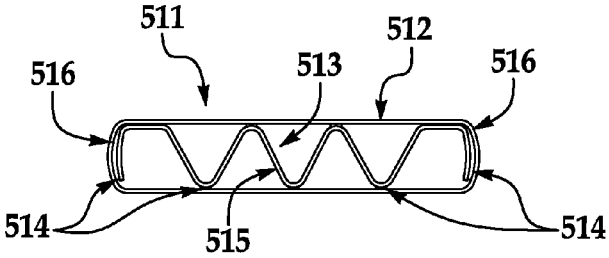
Figure 5C:
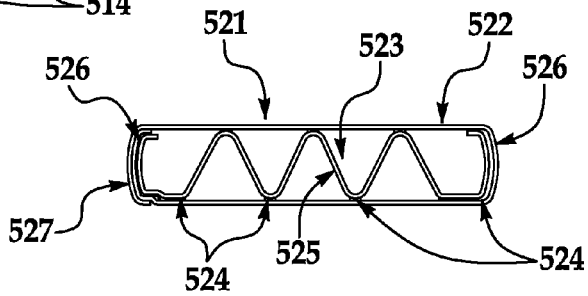

Referring to FIG. 5*a-c*, a domed tube assembly (501, 511, 521) is shown with a tube (502, 512, 522) and a tube strengthener-end contact (503, 513, 523). The tube strengthener-end contact consists of a fin (505, 515, 525) for strength and heat transfer, a localized contact surface (504, 514, 524), and an end contact (506, 516, 526). Preferably, the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and the tube strengthener-end contact plus tube at the localized contact area form a strengthened joint comprising the tube, the tube strengthener, and the header, where the tube touches or abuts the header (header joint). The header joint is brazed to form a brazed header joint.

Referring to FIG. 5*a*, the contour of the tube strengthener-end contact is formed such that the end contact (506) radius contacts the inner wall of the tube, and preferably, contacts the inner wall of the tube at the localized contact surface (504). The contour of the tube strengthener-end contact completely covers the inside tube minor dimension radius, thereby forming a strengthened joint when the heat exchanger is brazed.

Referring to FIG. 5*b*, the contour of the tube strengthener-end contact is formed such that the end contact (516) radius contacts the inner wall of the tube, and preferably, contacts the inner wall of the tube at the localized contact surface (514). The localized contact area abuts part of one outer upper end radius on one side of the tube and part of one outer bottom end radius of the respective tube strengthener-end contact on the opposite side of the tube, the tube strengthener-end contact contacting or abutting only a portion of the inner tube in the area between the inner upper end radius to the bottom end radius of the tube on either end. The contour of the tube strengthener-end contact partially covers the inside tube minor dimension radius, thereby forming a strengthened joint when the heat exchanger is brazed but according to the durability requirements of the heat exchanger.

Referring to FIG. 5*c*, the contour of the tube strengthener-end contact is formed such that the end contact (526) contacts the inner wall of the tube, and preferably, contacts the inner wall of the tube at the localized contact surface (524). The contour of the tube strengthener-end contact covering all or a portion of one inside tube minor dimension radius, thereby forming a strengthened joint when the heat exchanger is brazed. The second inside tube minor dimension radius is a folded tube end (527) and provides a strengthened joint that is supported by the tube strengthener-end contact adjacent to the folded tube end or covering all or a portion or none of the inside tube minor dimension radius.

Referring to FIG. 6*a-d*, a rectangular tube assembly (601, 611, 621, 631) is shown with a tube (602, 612, 622, 632) and a tube strengthener-end contact (603, 613, 623, 633). The tube strengthener-end contact consists of a fin (605, 615, 625, 635) for strength and heat transfer, a localized contact surface (604, 614, 624, 634), and an end contact (606, 616, 626, 636). Preferably, the tube strengthener-end contact follows the contour of the inner tube, more preferably, the entire contour of the inner tube provides the localized contact area for the tube strengthener-end contact in the area of contact of the tube strengthener-end contact. Preferably, the tube strengthener-end contact abuts the tube at a localized contact area, and the tube strengthener-end contact plus the tube at the localized contact area form a strengthened joint comprising the tube, the tube strengthener, and the header, where the tube touches or abuts the header (header joint). The header joint is brazed to form a brazed header joint.

Figure 6A:
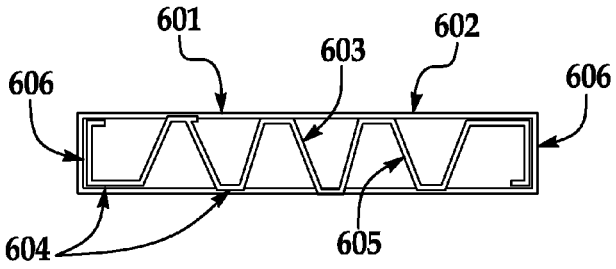
FIG. 6*a-d* is a cross sectional schematic end view of a tube strengthener-end contact in a rectangular shaped tube, in accordance with an aspect of the present disclosure.

Referring to FIG. 6*a*, the contour of the tube strengthener-end contact is formed such that the end contact (606) contacts the inner wall of the tube, and preferably, contacts the inner wall of the tube at the localized contact surface (604). The contour of the tube strengthener-end contact completely covers the inside tube minor dimension, thereby forming a strengthened joint when the heat exchanger is brazed.

Figure 6B:
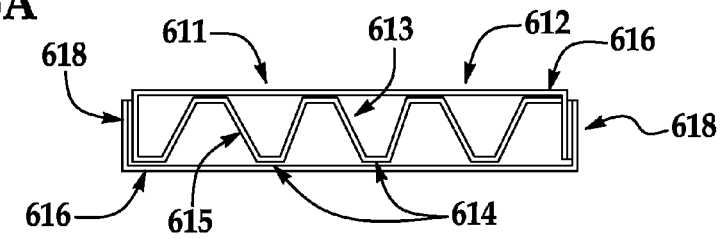

Referring to FIG. 6*b*, the contour of the tube strengthener-end contact is formed such that the end contact (616) contacts the inner wall of the tube, and preferably, contacts the inner wall of the tube at the localized contact area (614). The localized contact area, at a minimum, abuts part of, partial, or completely one or both minor tube dimension wall or any combination. The inside tube wall minor dimension is a nested (618) tube design that provides a strengthened joint that is supported by the tube strengthener-end contact adjacent to the nested tube end or covering all, a portion, or none of the inside tube minor dimension leg.

Figure 6C:
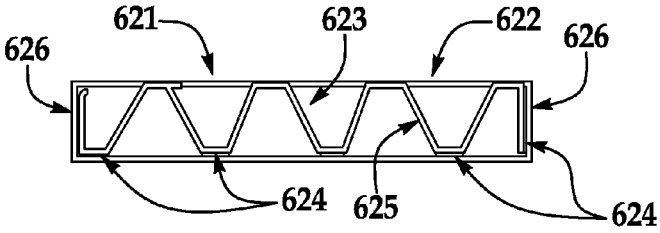

Referring to FIG. 6*c*, the contour of the tube strengthener-end contact is formed such that the end contact (626) contacts the inner wall of the tube, and preferably, contacts the inner all of the tube at the localized contact surface (624). The localized contact area abuts part of one outer upper end contact on one side of the tube and part of one outer bottom end contact of the respective tube strengthener-end contact on the opposite side of the tube. The tube strengthener-end contact contacts or abuts only a portion of the inner tube in the area between the inner upper end minor dimension to the bottom end minor dimension of the tube on either end. The contour of the tube strengthener-end contact partially covers the inside tube minor dimension end, thereby forming a strengthened joint when the heat exchanger is brazed but according to the durability requirements of the heat exchanger.

Figure 6D:
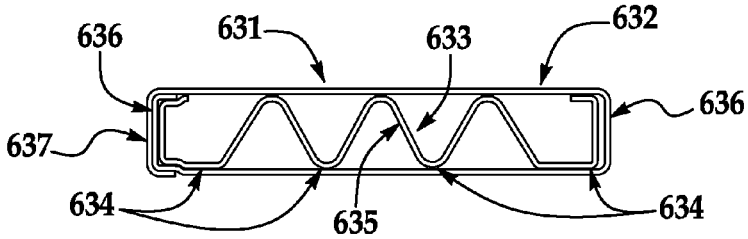

Referring to FIG. 6*d*, the contour of the tube strengthener-end contact is formed such that the end radius (636) contacts the inner wall of the tube, and preferably, contacts the inner wall of the tube at the localized contact surface (634). The contour of the tube strengthener-end contact covers all or a portion of one inside tube minor dimension, thereby forming a strengthened joint when the heat exchanger is brazed. The second inside tube minor dimension radius is a folded tube end (637) and provides a strengthened joint that is supported by the tube strengthener-end contact adjacent to the folded tube end or covering all or a portion of the inside tube minor dimension radius.

Figure 7:
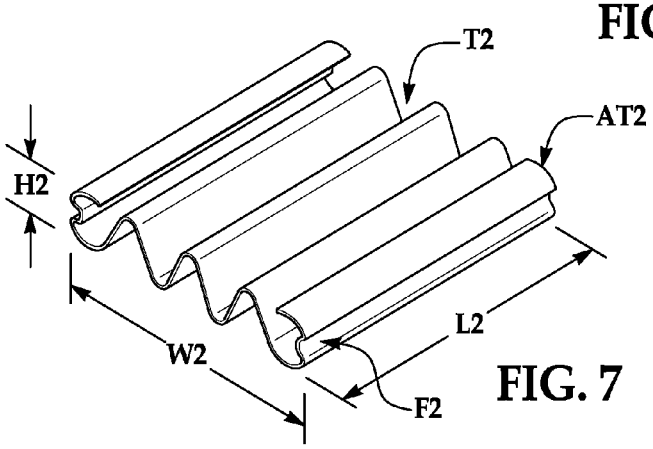
FIG. 7 is an elevational schematic view of a tube strengthener-structural, in accordance with an aspect of the present disclosure.

FIG. 7 depicts a tube strengthener-structural having an internal dimension and a length (L2) greater than 5 mm and less than ½ length of the tube that can be placed in an oval or oblong or rectangular or dome shaped tube, in accordance with an aspect of the present disclosure. The number of fins is dependent on the width (W2) of the tube strengthener. The tube strengthener-structural is of the width (W2) and a height (H2) to match the inner dimension of the tube. Material thickness (T2) is greater than of the design internal fin or greater than 25% of the tube wall thickness. One or more formed structures (F2) (fin features or design aspects as described herein above) is located adjacent to an additional thickness (AT2) with a shape that is dependant on space and engineering requirements to resist localized stresses in the tube. The formed structure (F2) is located next to the additional thickness (AT2) with a visible gap between the inside wall of the tube and the outside wall of the tube strengthener-structural. The additional thickness (AT2) brazed contact surface is dependant on the style of tube chosen, stresses within the heat exchanger, and resistance to the localized stresses needed at the point of contact.

Referring to FIG. 8*a-d*, an oval tube assembly (801, 811, 821, 831) is shown with a tube (802, 812, 822, 832) and a tube strengthener-structural (803, 813, 823, 833). The tube strengthener-structural consists of the fin (805, 815, 825, 835) for strength and heat transfer, a localized contact surface (804, 814, 824, 834), an additional thickness (809, 819, 829, 839), and a formed structure (806, 807, 816, 817, 826, 836, 837). The formed structure may be a combination of straight, curved, and rectangular fin features or design aspects that are adjacent to an additional thickness area secured by brazing to the inside tube surface, which have a gap between the inside tube surface and the outside surface of the tube strengthener-structural. Preferably, the tube strengthener-structural follows the contour of the inner tube, more preferably, the entire contour of the inner tube provides the localized contact area for the tube strengthener-structural in the area of contact of the tube strengthener-structural. Preferably, the tube strengthener-structural abuts the tube at a localized contact area, and the tube strengthener-structural plus the tube at the localized contact area form a strengthened joint comprising the tube, the tube strengthener, and the header where the tube touches or abuts the header (header joint). The header joint is brazed to form a brazed header joint.

Figure 8A:
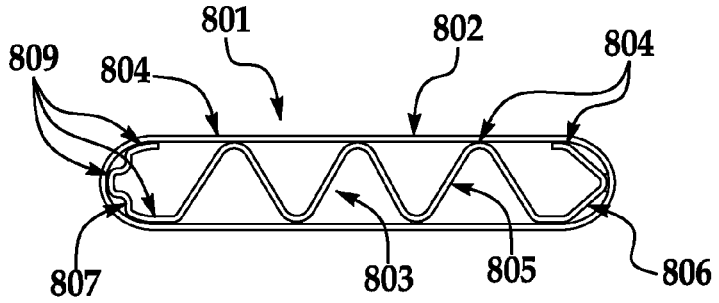
FIGS. 8*a-d* are cross sectional schematic views of a tube strengthener-structural in an oval tube, in accordance with an aspect of the present disclosure.

Referring to FIG. 8*a*, in an aspect of the disclosure there are formed structures (806, 807) with additional thickness (809) areas at the tube minor dimension end radius. The contour of the tube strengthener-structural covering the inside tube minor dimension radius with at least three additional thicknesses (809) and at least two adjacent formed structures (806, 807) for further localized strengthening of the tube assembly at the area of greatest stress, thereby forming a strengthened joint when the heat exchanger is brazed.

Figure 8B:
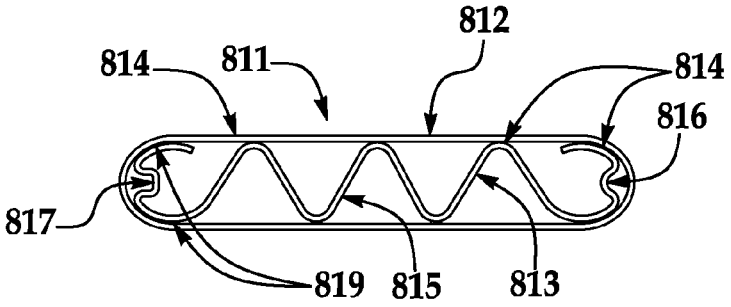

Referring to FIG. 8*b*, in an aspect of the disclosure there are formed structures (816, 817) with additional thickness (819) areas at the tube minor dimension end radius. The contour of the tube strengthener-structural covering the inside tube minor dimension radius with at least two or less additional thicknesses (819) and at least one adjacent formed structure (816, 817) for further localized strengthening of the tube assembly at the area of greatest stress, thereby forming a strengthened joint when the heat exchanger is brazed.

Figure 8C:
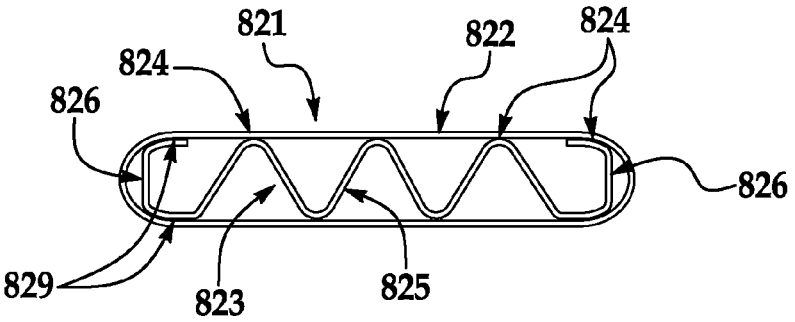

FIG. 8*c*, in an aspect of the disclosure, shows the formed structure (826) with additional thickness (829) areas at the tube minor dimension end radius. The contour of the tube strengthener-structural covering the inside tube minor dimension radius with at least two or less additional thicknesses (829) and at least one adjacent formed structure (826) for further localized strengthening of the tube assembly at the area of greatest stress, thereby forming a strengthened joint when the heat exchanger is brazed. The formed structure consisting of a portion of the tube strengthener-structural that is straight and approximately perpendicular to the tube major dimension surface.

Figure 8D:
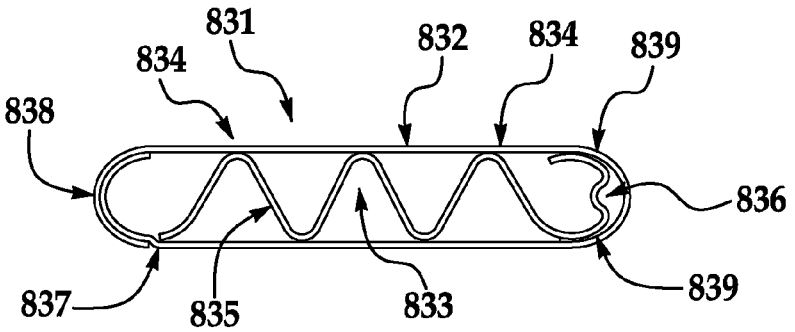

FIG. 8*d*, in an aspect of the disclosure, shows formed structures (836, 837) with additional thickness (839) areas at the tube minor dimension end radius. One side of the inside tube minor dimension radius is a folded tube end (838) and provides a strengthened joint that is supported by the tube strengthener-structural. The localized contact area (834) at a minimum abuts part of, partially, or completely the minor tube dimension wall of the folded tube (838) and is supported by the formed structure (837) adjacent to covering all, a portion, or none of the inside folded tube minor dimension leg. The contour of the tube strengthener-structural covers the inside tube minor dimension radius with at least two or less additional thickness (839) and at least one adjacent formed structure (836,837) for further localized strengthening of the tube assembly at the area of greatest stress, thereby forming a strengthened joint when the heat exchanger is brazed.

Figure 9A:
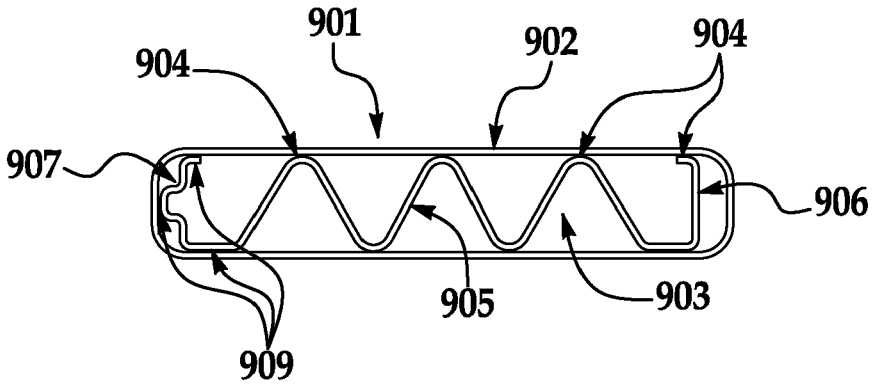
FIGS. 9*a-c* are cross sectional schematic views of a tube strengthener-structural in a rectangular tube, in accordance with an aspect of the present disclosure.
Figure 9B:
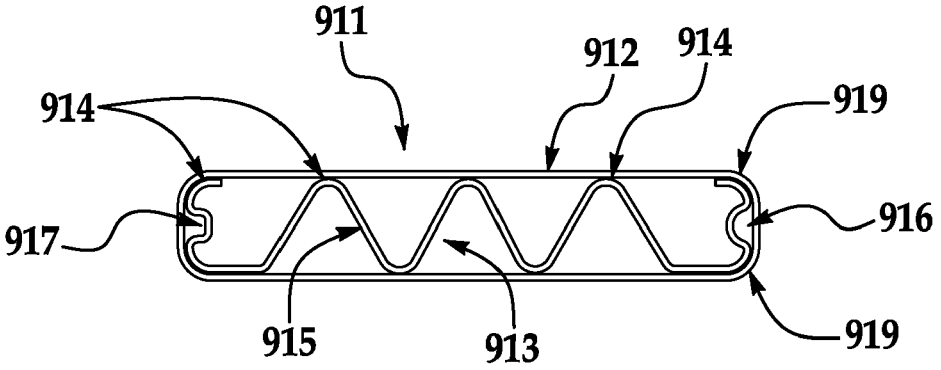
Figure 9C:
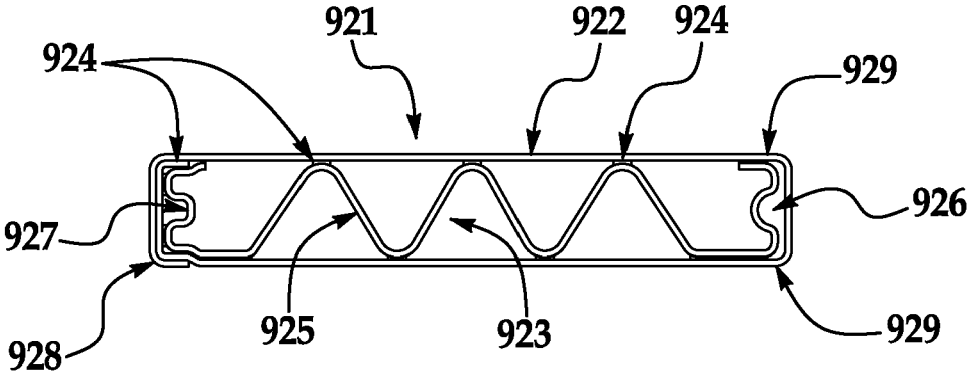

Referring to FIG. 9*a-c*, a rectangular tube assembly (901, 911, 921) is shown with a tube (902, 912, 922) and a tube strengthener-structural (903, 913, 923). The tube strengthener-structural consists of the fin (905, 915, 925) for strength and heat transfer, a localized contact surface (904, 914, 924), an additional thickness (909, 919, 929), and a formed structure (906, 907, 916, 917, 926, 927). The formed structure may be a combination of straight, curved, and rectangular features that are adjacent to an additional thickness area secured by brazing to the inside tube surface, which have a gap between the inside tube surface and the outside surface of the tube strengthener-structural. Preferably, the tube strengthener-structural follows the contour of the inner tube, more preferably, the entire contour of the inner tube provides the localized contact area for the tube strengthener-structural in the area of contact of the tube strengthener-structural. Preferably, the tube strengthener-structural abuts the tube at a localized contact area, and the tube strengthener-structural plus the tube at the localized contact area form a strengthened joint comprising the tube, the tube strengthener, and the header, where the tube touches or abuts the header (header joint). The header joint is brazed to form a brazed header joint.

Referring to FIG. 9*a*, in an aspect of the disclosure there are formed structures (906, 907) with additional thickness (909) areas at the tube end minor dimension. The contour of one end of the tube strengthener-structural covering the inside tube minor dimension radius with at least three additional thickness (909) and at least two adjacent formed structure (907). The contour of one end of the tube strengthener-structural that is straight and approximately perpendicular from the tube major dimension surface. The tube strengthener-structural utilizing either one or both of the formed structures according to the resistance to stress required in the tube assembly, thereby forming a strengthened joint when the heat exchanger is brazed.

FIG. 9*b*, in an aspect of the disclosure, shows formed structures (916, 917) with additional thickness (919) areas at the tube minor dimension end. The contour of the tube strengthener-structural covering the inside tube minor dimension with at least two or less additional thickness (919) and at least one adjacent formed structures (916, 917) for further localized strengthening of the tube assembly at the area of greatest stress, thereby forming a strengthened joint when the heat exchanger is brazed.

FIG. 9*c*, in an aspect of the disclosure, shows formed structures (926, 927) with additional thickness (929) areas at the tube end minor dimension. One side of the inside tube end minor dimension is a folded tube end (928) and provides a strengthened joint that is supported by the tube strengthener-structural. The localized contact area (924) at a minimum, abuts part of, partially, or completely the minor tube dimension wall of the folded tube (928) and is supported by the folded structure (927) adjacent to covering all, a portion, or none of the inside folded tube minor dimension leg. The contour of the tube strengthener-structural covering the inside tube end minor dimension with at least two or less additional thicknesses (929) and at least one adjacent formed structure (926,927) for further localized strengthening of the tube assembly at the area of greatest stress, thereby forming a strengthened joint when the heat exchanger is brazed.

Figure 10A:
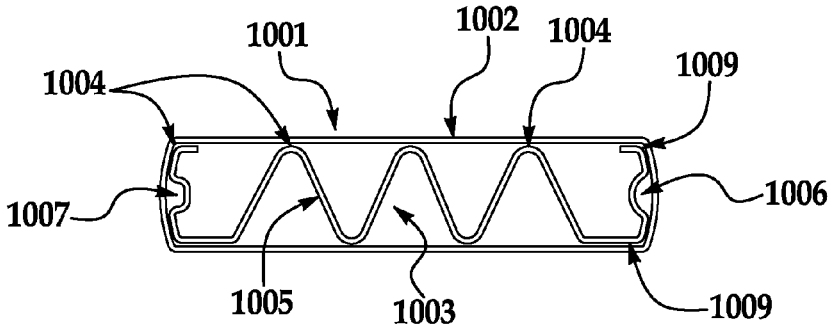
FIGS. 10*a-c* are cross sectional schematic views of a tube strengthener-structural in a domed tube, in accordance with an aspect of the present disclosure.
Figure 10B:
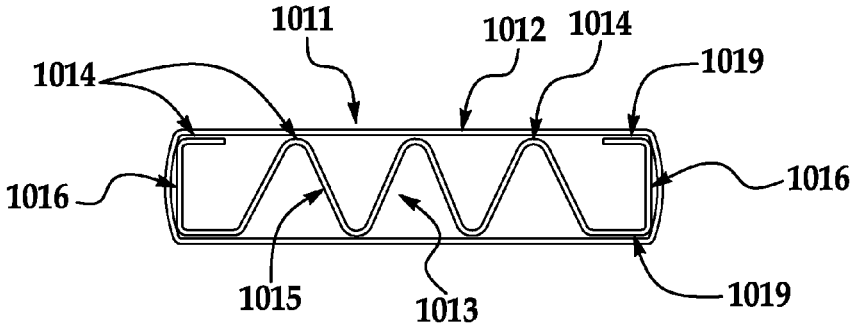
Figure 10C:
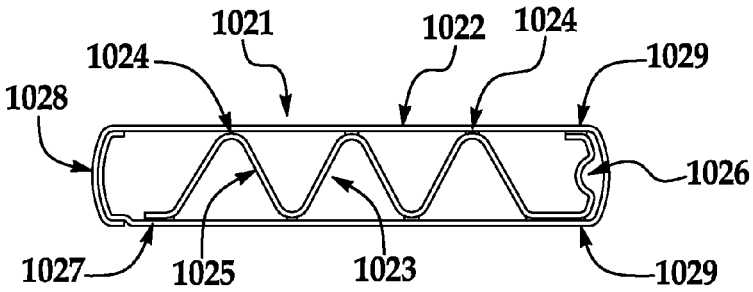

Referring to FIG. 10*a-c*, a domed tube assembly (1001, 1011, 1021) is shown with a tube (1002, 1012, 1022) and a tube strengthener-structural (1003, 1013, 1023). The tube strengthener-structural consists of a fin (1005, 1015, 1025) for strength and heat transfer, a localized contact surface (1004, 1014, 1024), an additional thickness (1009, 1019, 1029), and a formed structure (1006, 1007, 1016, 1017, 1026, 1027). The formed structure may be a combination of straight, curved, and rectangular features that are adjacent to an additional thickness area secured by brazing to the inside tube surface, which have a gap between the inside tube surface and the outside surface of the tube strengthener-structural. Preferably, the tube strengthener-structural follows the contour of the inner tube, more preferably, the entire contour of the inner tube and provides a localized contact area for the tube strengthener-structural in the area of contact of the tube strengthener-structural. Preferably, the tube strengthener-structural abuts the tube at a localized contact area, and the tube strengthener-structural plus the tube at the localized contact area form a strengthened joint comprising the tube, the tube strengthener, and the header, where the tube touches or abuts the header (header joint). The header joint is brazed to form a brazed header joint.

FIG. 10*a*, in an aspect of the disclosure, shows formed structures (1006, 1007) with additional thickness (1009) areas at the tube minor dimension end radius. The contour of the tube strengthener-structural covering the inside tube minor dimension radius with at least two additional thicknesses (1009) and at least one adjacent formed structure (1006, 1007) for further localized strengthening of the tube assembly at the area of greatest stress. This is a largely strengthened joint when the heat exchanger is brazed.

FIG. 10*b*, in an aspect of the disclosure, shows the formed structure (1016) with additional thickness (1019) areas at the tube minor dimension end radius. The contour of the tube strengthener-structural covering the inside tube minor dimension radius with at least two or less additional thicknesses (1019) and at least one adjacent formed structure (1016) for further localized strengthening of the tube assembly at the area of greatest stress. This is a largely strengthened joint when the heat exchanger is brazed. The formed structure consists of a portion of the tube strengthener-structural that is straight and approximately perpendicular from the tube major dimension surface.

FIG. 10*c*, in an aspect of the disclosure, shows formed structures (1026, 1027) with additional thickness (1029) areas at the tube minor dimension end radius. One side of the inside tube minor dimension radius is a folded tube end (1028) and provides a strengthened joint that is supported by the tube strengthener-structural. The localized contact area (1024) at a minimum, abuts part of, partially, or completely the minor tube dimension wall of the folded tube (1028) and is supported by the folded structure (1027) adjacent to covering all, a portion, or none of the inside folded tube minor dimension leg, thereby forming a strengthened joint when the heat exchanger is brazed. The other tube end minor dimension radius uses the contour of the tube strengthener-structural covering the inside tube minor dimension radius with at least two or less additional thicknesses (1029) and at least one adjacent formed structure (1026) for further localized strengthening of the tube assembly at the area of greatest stress. This is a largely strengthened joint when the heat exchanger is brazed.

Figure 11:
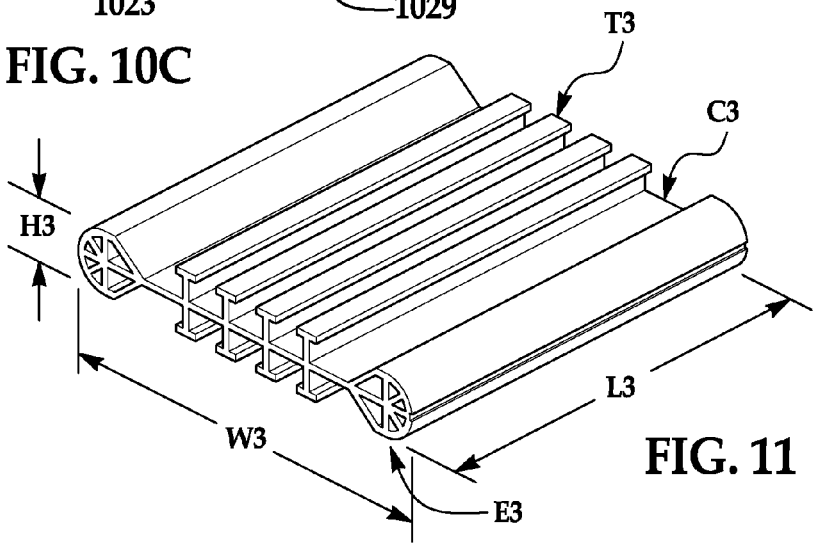
FIG. 11 is an elevational schematic end view of a tube strengthener-extruded, in accordance with an aspect of the present disclosure.

Referring to FIG. 11, a tube strengthener-extruded having an internal dimension and a length (L3) greater than 5 mm and less than ½ length of the tube can be placed in an oval, oblong, rectangular, or dome shaped tube, in accordance with an aspect of the present disclosure. All structures protrude from a central web (C3) with the outside surface of those structures brazed to the inside surface of tube. The structures off the central web (C3) may vary in thickness when compared with each other according to operational stress requirements. The number of fins is dependent on the width (W3) of the tube strengthener. The tube strengthener-extruded includes a width (W3) and a height (H3) to match the inner dimension of the tube. Material thickness (T3) is greater than, equal to, or less than the design internal fin or greater than 25% of the tube wall thickness with different cross sectional thickness(es) throughout the tube strengthener-extruded according to the cross sectional stresses in the tube assembly. One or more extruded structures (E3) is located in the tube end minor dimension radius with a shape, a thickness, and a number of stiffening members dependent on engineering requirements to resist localized stresses in the tube.

Figure 12A:
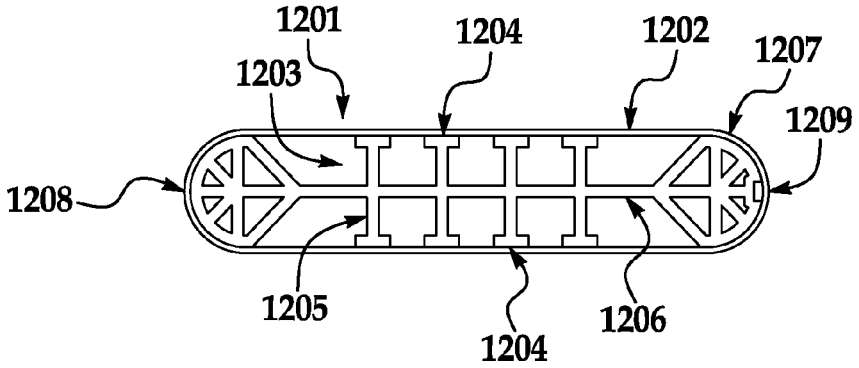
FIG. 12*a-b* is a cross sectional schematic of end view of a tube strengthener-extruded in an oval tube, in accordance with an aspect of the present disclosure.
Figure 12B:
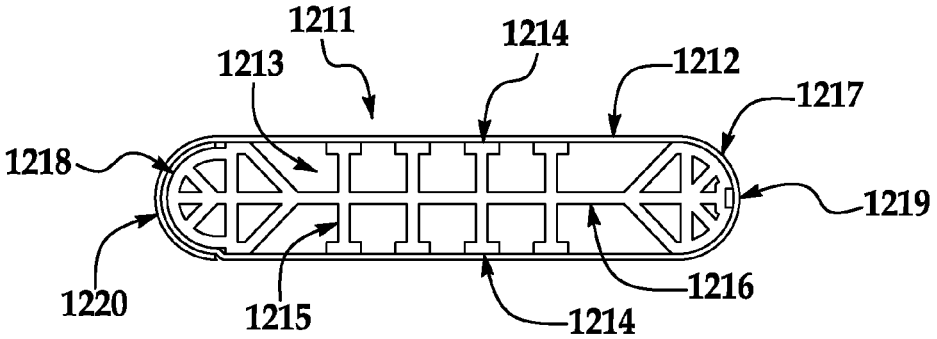

Referring to FIG. 12*a-b*, an oval tube assembly (1201, 1211) is shown with a tube (1202, 1212) and a tube strengthener-extruded (1203, 1213). The tube strengthener-extruded consists of a fin (1205, 1215) for strength and heat transfer, a localized contact surface (1204, 1214), an optional flux groove (1209, 1219), an optional central web (1206, 1216), and an extruded structure (1207, 1208, 1217, 1218). The central web is the base structure from which all other elements (such as the fins, the structure, and the flux grooves of the tube strengthener-extruded) project with the outside surfaces contacting the inside surface of the tube wall. These features may be in a combination of straight, curved, and rectangular features with the outside terminus against the tube interior wall. The tube strengthener-extruded may follow the contour of the inner tube and/or the entire contour of the inner tube provides the localized contact area for the tube strengthener-extruded in the area of contact of the tube strengthener-extruded. The tube strengthener-extruded may abut the tube at a localized contact area, and the tube strengthener-extruded plus the tube at the localized contact area form a strengthened joint comprising the tube, the tube strengthener-extruded, and the header, where the tube touches or abuts the header (header joint). The header joint is brazed to form a brazed header joint.

FIG. 12*a*, in an aspect of the disclosure, shows an extruded structure (1207, 1208) approximately centered about the central web (1206) providing strength in the locations of highest stress, normally the tube end minor dimension radius. Additionally, the fins (1205) with the localized contact surface (1204) projections contact the tube inside surface on the major dimension. The contour of the tube strengthener-extruded covers none, part of, or all of the inside tube minor dimension radius with the extruded structure with localized contact surfaces, where a flux groove (1209) is optional, thereby forming a strengthened joint when the heat exchanger is brazed.

FIG. 12*b*, in an aspect of the disclosure, shows an extruded structure (1217, 1218) approximately centered about the central web (1216) providing strength in the locations of highest stress, normally the tube end minor dimension radius. Additionally, the fins (1215) with the localized contact surface (1214) projections contact the tube inside surface on the major dimension. One side of the inside tube minor dimension radius is a folded tube end (1220) and provides a strengthened joint that is supported by the tube strengthener-structural. The localized contact area (1214) abuts part of, partially, or completely the minor tube dimension wall of the folded tube (1220) and is supported by the extruded structure (1218) adjacent to covering all, a portion, or none of the inside folded tube minor dimension leg. The contour of the tube strengthener-extruded covering none, part of, or all of the inside tube minor dimension radius with the extruded structure with localized contact surfaces, the flux groove (1219) is optional, thereby forming a single strengthened assembly by brazing.

Figure 13A:
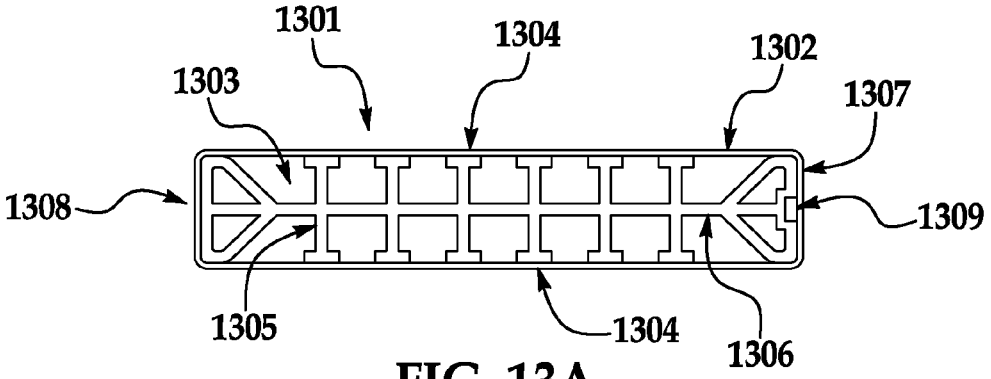
FIG. 13*a-b* is a cross sectional end view of a tube strengthener-extruded in a rectangular tube, in accordance with an aspect of the present disclosure.
Figure 13B:
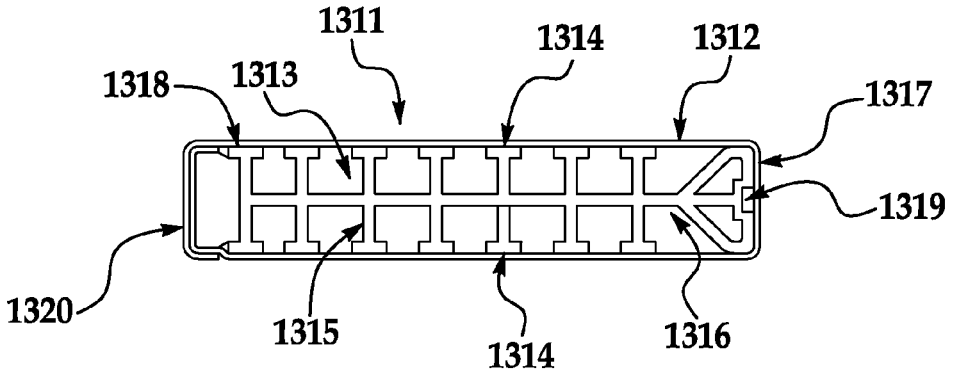

Referring to FIG. 13*a-b*, a rectangular tube assembly (1301, 1311) is shown with a tube (1302,1312) and a tube strengthener-extruded (1303, 1313). The tube strengthener-extruded consists of a fin (1305, 1315) for strength and heat transfer, a localized contact surface (1304, 1314), an optional flux groove (1309, 1319) optional, a central web (1306, 1316) and an extruded structure (1307, 1308, 1317, 1318). The central web is the base structure from which all other elements such as, the fins, the structure, and the flux grooves of the tube strengthener-extruded project with the outside surfaces contacting the inside surface of the tube wall. These features may be in a combination of straight, curved, and rectangular features with the outside terminus against the tube interior wall. The tube strengthener-extruded may follow the contour of the inner tube, or the entire contour of the inner tube provides the localized contact area for the tube strengthener-extruded in the area of contact of the tube strengthener-extruded. The tube strengthener-extruded in one aspect of the present disclosure abuts the tube at a localized contact area, and the tube strengthener-extruded plus the tube at the localized contact area form a strengthened joint comprising the tube, the tube strengthener-extruded, and the header, where the tube touches or abuts the header (header joint). The header joint is brazed to form a brazed header joint.

FIG. 13*a*, in an aspect of the disclosure, shows the extruded structure (1307, 1308) approximately centered about the central web (1306) providing strength in the locations of highest stress, normally the tube end minor dimension. Additionally, the fins (1305) with the localized contact surface (1304) projections contact the tube inside surface on the major dimension. The contour of the tube strengthener-extruded covering none, part of, or all of the inside tube minor dimension with an extruded structure with localized contact surfaces, the flux groove (1309) is optional, thereby forming a strengthened joint when the heat exchanger is brazed.

FIG. 13*b*, in an aspect of the disclosure, shows the extruded structure (1317, 1318) approximately centered about the central web (1316) providing strength in the locations of highest stress, normally the tube end minor dimension. Additionally, the fins (1315) with the localized contact surface (1314) projections contact the tube inside surface on the major dimension. One side of the inside tube minor dimension is a folded tube end (1320) and provides a strengthened joint that is supported by the tube strengthener-structural. The localized contact area (1314) abuts part of, partially, or completely the minor tube dimension wall of the folded tube (1320) and is supported by the extruded structure (1318) adjacent to covering all, a portion, or none of the inside folded tube minor dimension leg. The contour of the tube strengthener-extruded covering none, part of, or all of the inside tube minor dimension radius with an extruded structure with localized contact surfaces, a flux groove (1319) is optional, thereby forming a single strengthened assembly by brazing.

Figure 14A:
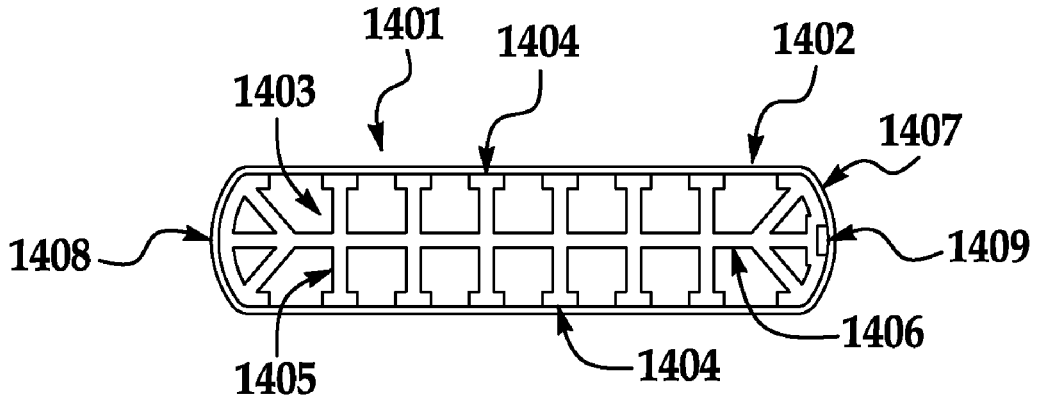
FIG. 14*a-b* is a cross sectional schematic view of a internal fin with end views of a tube strengthener-extruded in a domed tube, in accordance with an aspect of the present disclosure.
Figure 14B:
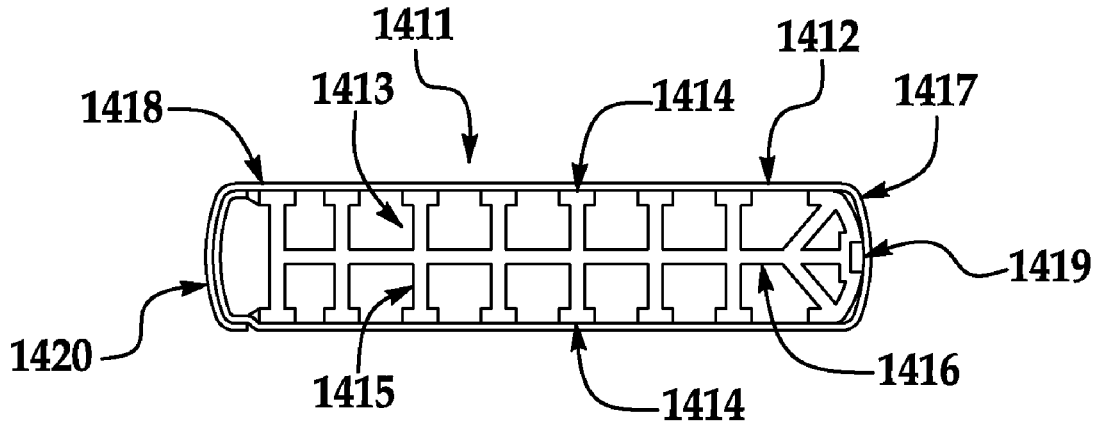

Referring to FIG. 14*a-b*, a domed tube assembly (1401, 1411) is shown with a tube (1402, 1412) and a tube strengthener-extruded (1403, 1413). The tube strengthener-extruded consists of a fin (1405, 1415) for strength and heat transfer, a localized contact surface (1404, 1414), an optional flux groove (1409, 1419), an optional central web (1406, 1416), and an extruded structure (1407, 1408, 1417, 1418). The central web is the base structure from which all other elements such as the fins, the structure, and the flux grooves of the tube strengthener-extruded project with the outside surfaces contacting the inside surface of the tube wall. The feature may be in a combination of straight, curved, and rectangular features with the outside terminus against the tube interior wall. Preferably, the tube strengthener-extruded follows the contour of the inner tube, more preferably, the entire contour of the inner tube provides the localized contact area for the tube strengthener-extruded in the area of contact of the tube strengthener-extruded. Preferably, the tube strengthener-extruded abuts the tube at a localized contact area, and the tube strengthener-extruded plus the tube at the localized contact area form a strengthened joint comprising the tube, the tube strengthener-extruded, and the header, where the tube touches or abuts the header (header joint). The header joint is brazed to form a brazed header joint.

FIG. 14*a*, in an aspect of the disclosure, shows the extruded structure (1407, 1408) approximately centered about the central web (1406) providing strength in the locations of highest stress, normally the tube end minor dimension radius. Additionally, the fins (1405) with the localized contact surface (1404) projections contact the tube inside surface on the major dimension. The contour of the tube strengthener-extruded covers none, part of, or all of the inside tube minor dimension radius with an extruded structure with the localized contact surfaces, a flux groove (1409) is optional, thereby forming a strengthened joint when the heat exchanger is brazed.

FIG. 14*b*, in an aspect of the disclosure, shows the extruded structure (1417, 1418) approximately centered about the central web (1416) providing strength in the locations of highest stress, normally the tube end minor dimension radius. Additionally, the fins (1415) with the localized contact surface (1414) projections contact the tube inside surface on the major dimension. One side of the inside tube minor dimension radius is a folded tube end (1420) and provides a strengthened joint that is supported by the tube strengthener-structural. The localized contact area (1414) at a minimum abuts part of, partially, or completely the minor tube dimension wall of the folded tube (1420) and is supported by the extruded structure (1418) adjacent to covering all, a portion, or none of the inside folded tube minor dimension leg. The contour of the tube strengthener-extruded covering none, part of, or all of the inside tube minor dimension radius with an extruded structure with localized contact surfaces, a flux groove (1419) is optional, thereby forming a single strengthened assembly by brazing.

Aspects of the present disclosure are variable as they relate to size, length, thickness, and number of fins that are used to form the tube strengtheners, and their exact geometric shape may vary dependent on the actual heat exchanger assembly and application and tube design of the assembly. In high stress environmental applications, the overall thickness of the tube wall and tube strengthener may vary, for example, specific charge air cooler applications and tube design may vary.

In heat exchangers with stressful temperature/pressure operating conditions, aspects of the present disclosure having a tube strengthener are beneficial, for example, in CAC designs. Such aspects can be applied with minimal additional labor and only minor modification of manufacturing operations. In various aspects of a method of the present disclosure, an automated tube stuffer (an automated means or machine of insertion of a turbulator or fin into a tube) can be applied. In such applications, the strengthener can be the first or the last internal fin inserted in the tube and provides for ease of production. In aspects of the disclosure having a tube strengthener using an extruded internal fin or internal fin, the use of extrusion dies gives flexibility to the engineer or designer in designing the extruded external fin or internal fin so that appropriate strength under stressful environmental operating conditions is obtained with a minimum of material and structure, focalized at the location or locations of minimal stress, as well as allowing the designer the flexibility to add structure and material at the locations of highest stress as appropriate.

The relative size, length, thickness, and number of fins and exact geometric shape of a heat exchanger assembly, in accordance with the present disclosure, may vary depending on the heat exchanger application used (e.g. radiator, condenser, after cooler, charge air cooler, air to oil cooler, exhaust gas recirculation cooler (ERG)), and tube design.

In aspects of the present disclosure, a method of making a heat exchanger comprising a tube, internal fin or fins, a tube strengthener or strengtheners comprises forming an internal fin or fins with a tube strengthener or strengtheners; stuffing the internal fin or fins with a fin strengthener strengtheners into the tube; localizing the tube strengthener or strengtheners with the tube at areas of the tube in order to provide increased strength or durability to the heat exchanger; brazing the tube and a header at the header joint to form a brazed joint of increased thermal durability is contemplated. In some methods of the present disclosure, the step of localizing the tube strengthener or strengtheners at the region of the header joint, and brazing the tube and header at the header joint to form a brazed joint of increased thermal durability are also contemplated.

Unless stated otherwise, dimensions and geometries of the various structures depicted herein are not intended to be restrictive of the disclosure, and other dimensions or geometries are possible. Plural structural components can be provided by a single integrated structure. Alternatively, a single integrated structure might be divided into separate plural components. In addition, while a feature of the present disclosure may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present disclosure.

The preferred embodiment of the present disclosure has been disclosed. A person of ordinary skill in the art would realize however, that certain modifications would come within the teachings of this disclosure. Therefore, the following claims should be studied to determine the true scope and content of the disclosure.

What is claimed is:

1. A heat exchanger assembly, comprising:

a first end tank;

a second end tank opposite the first end tank;

at least one tube in fluid communication with the first and second end tanks, the at one least tube adapted to have a fluid flow therethrough;

at least one tube strengthener; and at least one internal fin distinct from the tube strengthener;

wherein:

the at least one tube strengthener and the at least one internal fin are positioned inside the at least one tube;

the at least one tube strengthener replaces an end portion of the internal fin; and the at least one tube strengthener is joined to the at least one tube at localized, spaced-apart joints alternating with portions of an inner surface of the at least one tube that are not in contact with or joined to the at least one tube strengthener in a cross-section orthogonal to a longitudinal axis of the at least one tube.

2. The heat exchanger assembly as defined in claim 1 wherein the heat exchanger assembly is brazed.

3. The heat exchanger assembly as defined in claim 2 wherein the at least one tube and at least one of the first end tank or the second end tank contact each other to form a header joint.

4. The heat exchanger assembly as defined in claim 1 wherein the at least one tube strengthener is a tube strengthener-end contact or a tube strengthener-structural.

5. The heat exchanger assembly as defined in claim 4 wherein the at least one tube strengthener is a tube strengthener-structural.

6. The heat exchanger assembly as defined in claim 1 wherein the at least one tube strengthener is a tube strengthener-extruded.

7. The heat exchanger assembly as defined in claim 6 wherein the heat exchanger assembly is brazed.

8. The heat exchanger assembly as defined in claim 4 wherein a modified fin is positioned inside the at least one tube such that the modified fin is an outermost modified fin that contacts and follows the contour of an inside wall of the at least one tube on either the radius or the minor dimension of the at least one tube.

9. The heat exchanger assembly as defined in claim 8 wherein the overall thickness of the modified fin and the at least one tube at the point of contact is approximately equal to or greater than the thickness of the at least one tube at one or more areas outside of an area of contact between the modified fin and the at least one tube.

10. The heat exchanger assembly as defined in claim 3 wherein the overall thickness of the at least one internal fin and the at least one tube at the header joint is greater than or equal to the thickness of the tube at one or more areas outside of the area of contact between the at least one internal fin and the at least one tube.

11. The heat exchanger assembly as defined in claim 3 wherein the header joint is a brazed joint.

12. A heat exchanger assembly, comprising:

a first end tank;

a second end tank opposite the first end tank;

at least one tube positioned between the first and second end tanks;

at least one tube strengthener; and at least one internal fin distinct from the tube strengthener;

wherein the at least one tube strengthener is positioned inside the at least one tube;

wherein the at least one tube is in fluid communication with at least the first end tank or the second end tank;

wherein the at least one tube strengthener is a tube strengthener-end contact or a tube strengthener-structural;

wherein the at least one tube strengthener is a complete modified fin, a piece of a modified fin, or a part of a modified fin positioned inside the at least one tube such that an outermost area of the modified fin contacts and follows the contour of an inside wall of the at least one tube on either the radius or minor dimension of the at least one tube;

and wherein the at least one tube strengthener is joined to the at least one tube at localized, spaced-apart joints alternating with portions of an inner surface of the at least one tube that are not in contact with or joined to the at least one tube strengthener in a cross-section orthogonal to a longitudinal axis of the at least one tube.

13. The heat exchanger assembly as defined in claim 12 wherein the at least one tube is adapted to have a fluid flow therethrough.

14. The heat exchanger assembly as defined in claim 13 wherein the heat exchanger is a turbo charger after cooler, a charge air cooler, or an EGR, wherein the tube strengthener is positioned at an area of highest thermal stress in the heat exchanger assembly.

15. The heat exchanger assembly as defined in claim 12 wherein the at least one tube strengthener is a tube strengthener-structural.

16. The heat exchanger assembly as defined in claim 12 wherein the heat exchanger is brazed.

17. The heat exchanger assembly as defined in claim 12 wherein the overall thickness of the modified fin and the at least one tube at the point of contact is approximately equal to or greater than the thickness of the at least one tube at one or more areas outside of the area of contact between the modified fin and the at least one tube.

18. The heat exchanger assembly as defined in claim 12 wherein the at least one tube and at least one of the first end tank or the second end tank contact each other to form a header joint.

19. The heat exchanger assembly as defined in claim 18 wherein the overall thickness of the at least one tube strengthener and the at least one tube at the point of the header joint is greater than or equal to the thickness of the at least one tube at one or more areas outside of the area of contact between the at least one tube strengthener and the at least one tube.

20. The heat exchanger assembly as defined in claim 18 wherein the header joint is a brazed joint.

21. The heat exchanger assembly as defined in claim 12 wherein the overall thickness of the at least one tube strengthener and the at least one tube at the point of the header joint is more than two and one half times the thickness of the at least one tube at a point of contact between the at least one tube strengthener and the at least one tube.

22. A heat exchanger assembly, comprising:

a first end tank;

a second end tank opposite the first end tank;

at least one tube having a fluid inlet defined in a first tube-end and having a fluid outlet defined in a second tube-end opposite the first tube-end, the at least one tube in fluid communication with the first end tank and the second end tank, the at least one tube defining a fluid flow path from the fluid inlet to the fluid outlet;

at least one tube strengthener disposed inside the at least one tube in a first segment of the fluid flow path wherein the at least one tube strengthener is joined to the at least one tube at localized, spaced-apart joints alternating with portions of an inner surface of the at least one tube that are not in contact with or joined to the at least one tube strengthener in a cross-section orthogonal to a longitudinal axis of the at least one tube; and at least one internal fin disposed inside the at least one tube in a second segment of the fluid flow path, serially adjacent to the first segment of the fluid flow path.

23. The heat exchanger assembly as defined in claim 22 wherein the at least one tube strengthener is a tube strengthener-end contact or a tube strengthener-structural.

24. The heat exchanger assembly as defined in claim 23 wherein the at least one tube strengthener is a modified fin positioned inside the at least one tube such that the tube strengthener is disposed substantially adjacent the first tube-end or the second tube-end, and is disposed between the at least one internal fin and the first tube-end or the second tube-end, and wherein the tube strengthener contacts and follows the contour of an inside wall of the at least one tube on either the radius or the minor dimension of the at least one tube.

* * * * *